United States Patent [19]

Killingstad

[11] Patent Number: 4,825,507

[45] Date of Patent: May 2, 1989

[54] SCREW OPERATED AJUSTABLY POSITIONED HINGE LEAF

[75] Inventor: Tore Killingstad, Oslo, Norway

[73] Assignee: A/S Grorud Jernvarefabrik, Oslo, Norway

[21] Appl. No.: 127,146

[22] Filed: Dec. 1, 1987

[30] Foreign Application Priority Data

Jul. 28, 1987 [NO] Norway ..... 873165

[51] Int. Cl.[4] ..... E05D 7/06

[52] U.S. Cl. ..... 16/241; 16/246249; 16/DIG. 39

[58] Field of Search ..... 16/240, 241, 245, 246, 16/249, 252, 382, DIG. 39, DIG. 40; 403/91

[56] References Cited

U.S. PATENT DOCUMENTS

| | | | |
|---|---|---|---|
| 310,033 | 12/1884 | Collamore | 16/246 |
| 375,038 | 12/1887 | Wright | 16/246 |
| 507,242 | 10/1893 | Partlow | 16/245 |
| 880,317 | 2/1908 | Von De Marwitz | 16/246 |
| 1,111,823 | 9/1914 | Hazelrigg. | |
| 1,419,479 | 6/1922 | Webber | 16/249 X |
| 1,893,252 | 1/1933 | Stabler | 16/245 |
| 3,728,758 | 4/1973 | Johansen | 16/382 X |

*Primary Examiner*—Fred A. Silverberg

*Attorney, Agent, or Firm*—Townsend and Townsend

[57] ABSTRACT

In a hinge for doors and the like one of the hinge blades is divided into two members, one member having a pocket in which the other member fits. The pocket has such a shape and size that the position of the other member in the pocket may be adjusted by the aid of adjustable stops in the shape of screws being provided in the hinge blade member for adjustment of a door panel in the associated door frame.

3 Claims, 2 Drawing Sheets

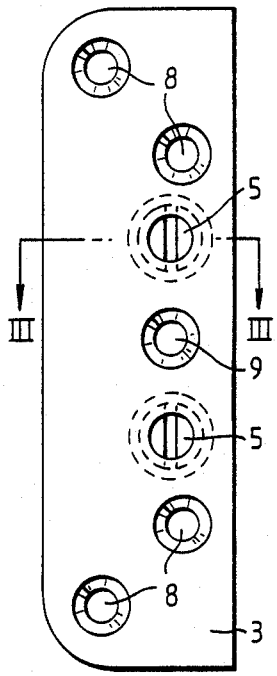
Fig.1.
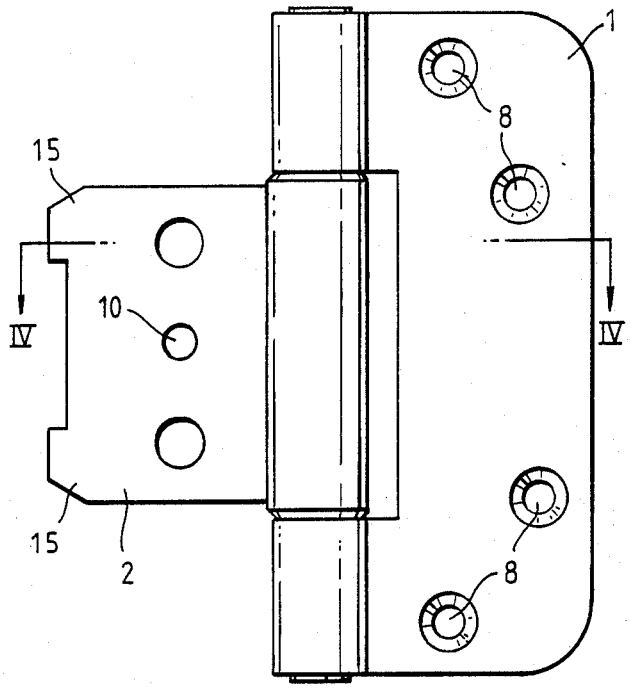
Fig.2.
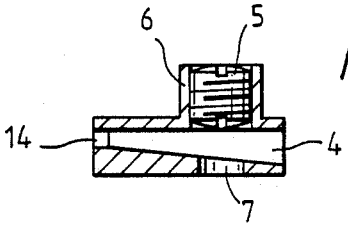
Fig.3.
Fig.4.
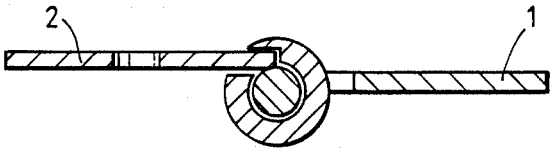

SCREW OPERATED AJUSTABLY POSITIONED HINGE LEAF

The present invention relates to an arrangement in a hinge, especially for doors, which, in a manner known per se, comprises hinge blades to be secured to a door panel, and a door frame, respectively, with a hinge pin constituting a slewable connection between the hinge blades.

With the passage of time door hinges of many different and more or less suitable designs were developed, among others hinges permitting adjustment of the door panel as regards height as well as inclination relative to the frame, however, without resulting in any satisfactory concept. As regards the inclination of the door panel in its frame, approaches were made with hinge pins having the bearing faces for the two hinge blades in a mutually excentric arrangement. When the hinge pin was turned in one hinge blade the pin of which was otherwise to be fixed the door panel was pulled closer to the door frame or displaced further away from the frame depending on the demand in each single case. A considerable disadvantage of such excentric hinge pins is that when being turned to move the door panel closer to or away from the frame they also displace the door panel in a direction normal to the plane of the door frame. Consequently, when the door panel is correctly adjusted in said plane there will be an incorrect adjustment of the door panel contact with the frame, e.g. resulting in no contact of the door panel on the hinged side, or in a contact so tight that it is difficult to close the door. This, in turn, may cause damage of the door panel and too high loads on the hinges. With this known concept it is, thus, impossible to make one adjustment alone without affecting the other adjustment as well.

It is an object of the present invention to eliminate this disadvantage by providing a hinge which permits a correct adjustment of the door panel to be made in the frame without said adjustment influencing the contact of the door panel in the same frame.

According to the invention this is achieved by the fact that one of the two blades of the hinge is constructed of two members which are readily adjustable relative to each other, and one member of which is intended for fastening in the door frame, whereas the other member is slewable on or with the hinge pin. Adjustability is made possible by the fact that the hinge blade member to be mounted in the door panel is pocket shaped with the other hinge blade member adapted to be received in said pocket with so much clearance that displacement of the latter hinge blade member in the pocket will result in displacement of the axis of rotation of the hinge, e.g. 4–5 mm from an original position, which is assumedly sufficient for doors used in private homes.

Figure 5:
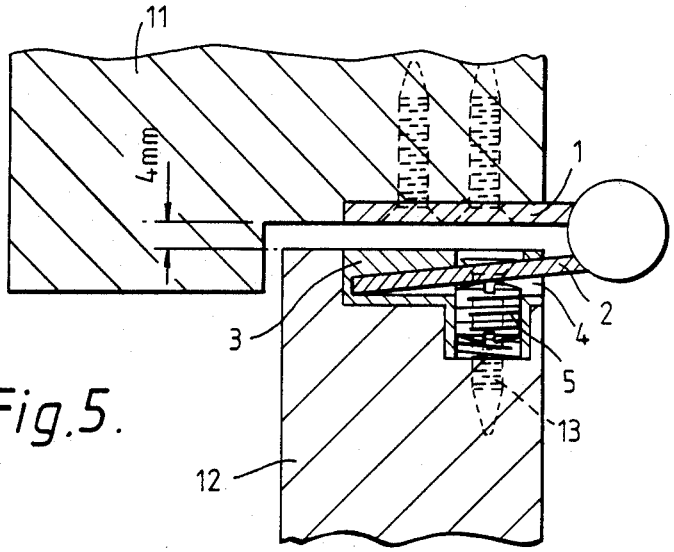
Figure 6:
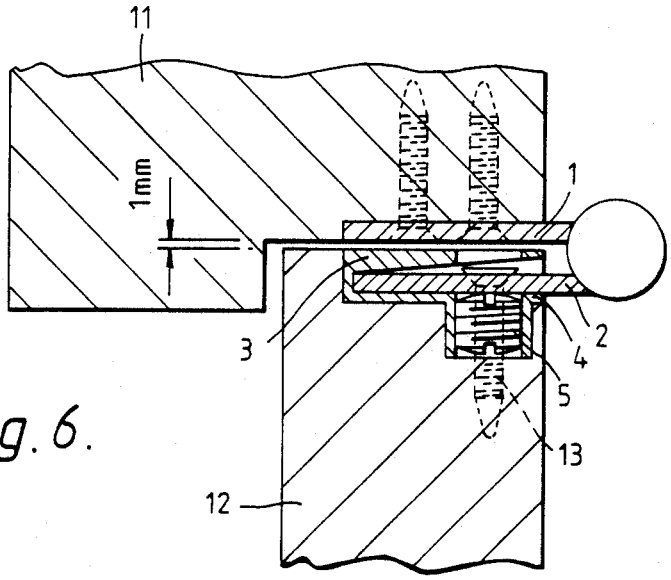

The invention is characterized by the features stated in the claims and will be disclosed in more detail below with reference to the drawings, in which FIGS. 1 and 2 show both hinge blades forming the hinge in a side elevation, FIGS. 3 and 4 show the same hinge blades in a sectional view and FIGS. 5 and 6 show door and frame as well as hinge in a sectional view in the two extreme positions of the range of adjustment.

In FIG. 2 the hinge comprises one hinge blade 1 of a conventional design with apertures shaped and placed according to demand and usage. The other hinge blade consists of two members 2 and 3, with member 2 hinged to member 1, whereas member 3 is loose in a non-mounted state. Member 3 has a pocket 4, as shown in FIG. 3, into which the tongue shaped hinge blade member 2 may be inserted, as shown in FIGS. 5 and 6. On one side of pocket 4 adjustable stops 5 are provided, which in the selected embodiment are shaped as two cylindrical screws each screw provided in a sleeve 6. In the opposite side of pocket 4 there are apertures 7 level with a sleeve 6 each, so that one end of screw 5 is accessible when the hinge blade members 3 are mounted on a door. Hinge blade member 3, in addition to conventional fastening holes 8 and sleeves 6, is provided with an aperture 9 for inserting a fastening screw for hinge blades 2, and said screw extends through an aperture 10 in member 2. When hinge blade 1 is fastened in door frame 11, and hinge blade member 3 is fastened in door panel 12, the door is mounted by lifting door panel 12 in place and moving hinge blade member 3 towards the tongue shaped hinge blade member 2 so that the latter is inserted in pocket 4, as shown in FIGS. 5 and 6. Screws 5, forming stops for hinge blade member 2, are adjusted to set hinge blade member 2 in the desired position, and to set the door panel in the way it should in the frame. Then fastening screw 13 is tightened and the door is mounted. If the door panel should, by any chance be obliquely positioned in the door frame, it may be adjusted by loosening securing screw 13 and adjusting stop screws 5 to achieve the correct position of the door. The range of adjustment of the selected embodiment is between 1 mm and 4 mm, as shown in FIGS. 5 and 6. This is considered to be sufficient for most utilizations. In FIGS. 5 and 6 the hinge is shown with its hinge blade member 2 in the extreme positions, but it is obviously possible to set the hinge in intermediate positions.

Pocket 4 in the hinge blade member 3 is wedge-shaped, as shown in the sectional view in FIG. 3, and the width at the bottom 14 approximately corresponds to the thickness of hinge blade member 2 making the latter tilt about the stop in the bottom of pocket 4 when adjusted. For further control of hinge blade member 2, the hinge blade member 2 may be provided with tongues 15 fitting into recesses at the bottom 14 of pocket 4.

When adjusted by the aid of the hinge according to the invention the door panel will, thus, not be pulled closer into or pushed out of the door frame, as is the case with hinges where the hinge pin is provided with two or more cylindrical faces in a mutual excentric relation. The contact between door panel and door frame is not changed which is especially important when the door is provided with draught excluders.

Having described my invention, I claim:

1. An improvement in a hinge, especially for doors, comprising hinge blades to be secured at a door panel, and a door frame, respectively, characterized in that at least one hinge blade is constructed of a first member and a second member, said first member intended for attachment to a door panel or frame, and said second member being adjustably connected with the first member, said second member having projecting tongues formed to cooperate with and fit into matching recesses in said first member for further control of the second member, said first member having a pocket in which the second member fits, and that the dimensions of said pocket are selected in such a manner in relation to the dimensions of the second member that said second member can move in the pocket, and that the pocket is provided with means for fixing the mutual position of the first and second members, said recesses being formed as an extension of said pocket, said pocket being wedgeshaped, said pocket having a wide open end and a narrow end, the width of the narrow end approximately corresponding to the thickness of the second member, said recesses being formed at the smallest end of said narrow end and extending in a direction away from the open end.

2. An improvement as defined in claim 1, further comprising a stop provided in the pocket against which the second member is to lie when a securing screw is tightened.

3. An improvement as defined in claim 2, characterized in that said stop is a screw which is accessible through an aperture in said first member for adjustment of the screw.

* * * * *